US012808027B2

(12) United States Patent
Dubois et al.

(10) Patent No.: US 12,808,027 B2
(45) Date of Patent: Nov. 24, 2026

(54) DEVICE FOR CLEANING A SNOUT IN A HOT-DIP GALVANIZATION INSTALLATION

(71) Applicant: JOHN COCKERILL SA, Seraing (BE)

(72) Inventors: Michel Dubois, Boncelles (BE); Fabian Pizzuto, Saint-Nicolas (BE)

(73) Assignee: JOHN COCKERILL S.A., Seraing (BE)

( * ) Notice: Subject to any disclaimer, the term of this patent is extended or adjusted under 35 U.S.C. 154(b) by 323 days.

(21) Appl. No.: 18/729,188

(22) PCT Filed: Jan. 17, 2023

(86) PCT No.: PCT/EP2023/050997
§ 371 (c)(1),
(2) Date: Jul. 16, 2024

(87) PCT Pub. No.: WO2023/143965
PCT Pub. Date: Aug. 3, 2023

(65) Prior Publication Data

US 2025/0109472 A1 Apr. 3, 2025

(30) Foreign Application Priority Data

Jan. 25, 2022 (EP) ..... 22153086

(51) Int. Cl.
*C23C 2/00* (2006.01)

(52) U.S. Cl.
CPC ..... *C23C 2/004* (2022.08); *C23C 2/0036* (2022.08); *C23C 2/523* (2022.08)

(58) Field of Classification Search
None
See application file for complete search history.

(56) References Cited

U.S. PATENT DOCUMENTS

2004/0052958 A1* 3/2004 Dauchelle ..... C23C 2/00344 118/100
2004/0052959 A1* 3/2004 Dauchelle ..... C23C 2/00 118/100

(Continued)

FOREIGN PATENT DOCUMENTS

JP H04120258 A 4/1992
KR 20190072999 A 6/2019

(Continued)

*Primary Examiner* — Mohammad M Ameen
(74) *Attorney, Agent, or Firm* — Leydig, Voit & Mayer, Ltd.

(57) ABSTRACT

A snout with cleaning device for connecting a liquid metal bath in a main pot to an annealing furnace in a continuous industrial installation for hot-dip coating a metal strip includes: a bottom section with a front side and a back side with respect to the metal strip in continuous movement entering into the liquid metal bath; and a cleaning device for differently cleaning a liquid metal surface located at the front side and the back side respectively, the cleaning device having a first dam located on the front side of the metal strip and a second dam located on the back side of the metal strip, the first dam and second dam being attached to the bottom section of the snout, a first dam top and a second dam top having respective positions which are fixed relative to each other.

19 Claims, 5 Drawing Sheets

(56) References Cited

U.S. PATENT DOCUMENTS

| | | | |
|---|---|---|---|
| 2015/0368776 | A1 | 12/2015 | Bergen et al. |
| 2016/0102393 | A1 | 4/2016 | Schaffrath et al. |
| 2023/0034415 | A1 | 2/2023 | Da Silva et al. |

FOREIGN PATENT DOCUMENTS

| | | | | |
|---|---|---|---|---|
| WO | WO 2019175623 | A1 | 9/2019 | |
| WO | WO 2021048593 | A1 | 3/2021 | |
| WO | WO-2021130422 | A1 * | 7/2021 | ..... C23C 2/526 |

* cited by examiner

DEVICE FOR CLEANING A SNOUT IN A HOT-DIP GALVANIZATION INSTALLATION

CROSS-REFERENCE TO PRIOR APPLICATIONS

This application is a U.S. National Phase application under 35 U.S.C. § 371 of International Application No. PCT/EP2023/050997, filed on Jan. 17, 2023, and claims benefit to European Patent Application No. EP 22153086.8, filed on Jan. 25, 2022. The International Application was published in English on Aug. 3, 2023 as WO 2023/143965 under PCT Article 21 (2).

FIELD

The present invention relates to the field of metal strip galvanization through continuous immersion in a bath of molten metal such as zinc, aluminium, silicon, magnesium, etc., and in particular to the so-called chute, or snout, or nozzle, through which the metal strip enters the bath, under a protective atmosphere. The invention particularly relates to a method for keeping the surface of the metal liquid clean of dirt particles or dross in the region of the snout.

BACKGROUND

In hot-dip coating of a metal strip, the necessity of cleaning the surface of the molten metal bath at the location where the metal strip enters into the bath is well-known, as the process induces accumulation of particles like zinc oxide or intermetallic floating that produce surface defects on the final coated product. Several methods are used to avoid the entrapment on these particles at the liquid metal surface.

Prior art designs are numerous but all have major problems whenever it comes to industrial operation, considering the strong constraints existing in the pot area like temperature, available space, uncertainties on the exact position of submerged equipment partly in relation with the heat expansion of the metal casing but also with the corrosion induced by the liquid metal and made of metal oxides and intermetallics that tends to "weld" the various movable components at the wetting line.

A first category of designs, the oldest ones and mostly in public domain, include systems with pumps for replacing the contaminated liquid metal by a clean one, snouts with variable geometry, push-pull systems with one or two pumps, etc.

Besides that, the principle of snout cleaning using devices such as weirs and reservoirs has been early disclosed for example in JPH04120258A (to Kawasaki), with a snout weir surrounding the approach point of a strip to a hot-dip galvanizing bath. The part of the snout dipped in the bath is hooked inward to form a dipping weir, and a discharge port is provided on the periphery of the snout. A pump is then driven by a motor to continuously discharge the liquid contained in the weir into the main plating bath through the discharge port and a pipeline. At this time, the speed of the bath from the discharge port is adjusted, and the relative speed between the strip entering from the centre opening of the weir and the liquid aspired from the main bath and overflowing in the opposite direction to the strip is controlled. The overflow over the weir can be increased on demand by increasing the liquid level in the main bath. The surface around the strip is then cleaned. Consequently, contact of the strip with the dross and ash floating on the bath surface is prevented.

Most systems propose a cleaning on one or the two sides of the strip with a continuous flow. The latter is very large for evacuation from the reservoir by the pumps, so that the pumps have to rotate at high speed what is known to increase the corrosion of the impeller but also to generate some type of zinc foam consisting in a mixture of Zn and Zn oxide around the shaft of the pump due to the turbulence induced. In addition, when the sink roll diameter changes due to maintenance operation, the relative front/back flow is modified, changing the process window due to the change of strip pass line and further of the snout position.

In devices showing an overflow on both sides, adjusting the control separately on each side by a tilting mechanism, intended to slightly rotate the bottom of the snout with respect of the reservoir, may induce the need for a lot of mechanical systems and complexity, but also the risk of poor tightness and further air entry that are detrimental to the quality of the coated steel strip.

Document US 2004/052959 A1 (to ArcelorMittal) relates a process and plant for the continuous dip-coating of a metal strip in a tank containing a liquid metal bath, in which process the metal strip is made to run continuously through a duct, the lower part of which is immersed in the liquid metal bath in order to define with the surface of the said bath a liquid seal. A natural flow of the liquid metal from the surface of the liquid seal is set up in two overflow compartments made in the said duct and each having an internal wall which extends the duct in its lower part and the level of liquid metal in the said compartments is maintained at a level below the surface of the liquid seal. The upper edges of both compartments are located at the same height.

Document US 2004/052958 A1 (to ArcelorMittal) relates to a process and plant for the continuous dip-coating of a metal strip in a tank containing a liquid metal bath, in which process the metal strip is made to run continuously through a duct, the lower part of which is immersed in the liquid metal bath in order to define with the surface of the said bath a seal. A natural flow of the liquid metal from the surface of the liquid seal is set up in an overflow compartment made in the said duct and having an internal wall which extends the duct in its lower part and the level of liquid metal in the said compartment is maintained at a level below the surface of the liquid seal. The overflow is exclusively allowed on the front dam of the duct. A back plate of the duct is part of a back compartment intended to collect zinc oxide dust particles.

Document WO 2021/048593 A1 (to ArcelorMittal) relates to an equipment for the continuous hot dip-coating of a metallic strip comprising: —an annealing furnace, —a tank containing a liquid metal bath, —a snout connecting the annealing furnace and said bath, through which the metallic strip runs in a protective atmosphere and the lower part of said snout, the snout tip, is at least partly immersed in the liquid metal bath in order to define with the surface of the bath, and inside this snout, a liquid seal, —a moveable support system, on at least one tank side, comprising connecting means, —an overflow connected to said moveable support system through said connecting means, comprising at least one vat and at a least one pump. In operation, the vat is positioned between the back side of the strip and the rear side of the snout.

Document WO 2019/175623 A1 (to ArcelorMittal) relates to an equipment for the continuous hot dip-coating of a metal strip comprising an annealing furnace, a tank containing a liquid metal bath, a snout connecting the annealing furnace and said tank, through which the metal strip runs in a protective atmosphere and the lower part of said snout, the sabot, is at least partly immersed in the liquid metal bath in order to define with the surface of the bath, and inside this snout, a liquid seal, an overflow not connected to the snout, said overflow comprising at least one tray, placed in the vicinity of the strip when entering said liquid metal bath and encompassed by said liquid seal. Advantageously, said overflow is formed by an internal wall facing one side of the strip, directed toward the surface of the liquid seal, the upper edge of which internal wall is positioned below the surface of said bath, an external wall facing the snout, directed toward the surface of the liquid seal, the upper edge of which external wall is positioned above the surface of said bath, and the internal wall upper edge is lower than the external wall upper edge. In this system it is impossible to separately control the overflow on each strip side.

Document WO 2021/130422 A1 (to Fives Stein) discloses a device for removing mattes from the surface of a liquid metal bath inside a duct of a line for continuously coating a metal strip having first and second faces, the first face being intended to come into contact with a bottom roller, comprising a compartment via which the liquid metal inside the duct is replenished by being drawn off by a pump to which the compartment is connected, characterised in that the compartment is capable of being removed by disassembly means without the metal strip needing to be cut. The device can consist either in one or in two compartments, one in front of each side of the strip, and the position, particularly the horizontality thereof, is adjustable independently of one another. However in practice such mechanical movements may be blocked with time, due to dross accumulation and/or corrosion.

Document US 2016/102393 A1 (to ThyssenKrupp Steel) relates to an apparatus for the continuous hot-dip coating of a metal strip, preferably a steel strip, comprising a melting bath vessel, a snout, which opens in the melting bath vessel, for introducing a metal strip, which is heated in a continuous furnace, into the melting bath in protective gas, and a deflecting roller, which is arranged in the melting bath vessel, for deflecting the metal strip, which is entering the melting bath, in a direction pointing out of the melting bath, wherein that end of the snout which is dipped into the melting bath has at least one runoff chamber which is bounded inward by an overflow wall, downward by a floor and outward by the wall of the snout, wherein the overflow edge of the overflow wall lies at least in sections below the melting bath surface, and wherein a suction line with a pump is connected to the runoff chamber, characterized in that the runoff chamber is provided with at least one through opening through which liquid molten metal can flow out of the melting bath into the runoff chamber, wherein the at least one through opening is arranged lower than the overflow edge.

Document US 2015/368776 A1 (to ThyssenKrupp Steel) discloses an apparatus for hot-dip coating a metal strip is disclosed having a dip bath vessel, a snout which opens into the dip bath vessel for introducing a metal strip which is heated in a continuous furnace into the dip bath, and a deflecting roller which is arranged in the dip bath vessel for deflecting the metal strip which enters into the dip bath in a direction which points out of the dip bath. The snout is provided with a shaft-shaped snout extension piece for increasing the snout dipping depth, the internal width of the snout extension piece tapering toward its outlet opening at least over a part length of said snout extension piece. As a result, an increase or maximization of the eddy flow in the molten metal at or close to the metal strip and therefore improved homogenization of the molten metal in the region of the strip is achieved, as a result of which slag-induced surface defects on the surface of the coated metal strip can be avoided.

The present invention aims to provide a solution to overcome the drawbacks of prior art.

In particular the invention is intended to provide the necessary differential cleaning of the respective front side and back side of the snout bottom section at the wetting line of liquid metal.

SUMMARY

In an embodiment, the present invention provides a snout with cleaning device for connecting a liquid metal bath in a main pot to an annealing furnace in a continuous industrial installation for hot-dip coating a metal strip, the snout comprising: a bottom section with a front side and a back side with respect to the metal strip in continuous movement entering into the liquid metal bath in use; and a cleaning device configured to differently clean a liquid metal surface located at the front side and the back side respectively, the cleaning device comprising a first dam located on the front side of the metal strip and a second dam located on the back side of the metal strip, the first dam and second dam being attached to the bottom section of the snout, a first dam top and a second dam top having respective positions which are fixed relative to each other, wherein the second dam top is located 5 to 50 mm above the first dam top, wherein mechanical means are provided to simultaneously adjust vertically the first dam top and the second dam top relative to a surface of the liquid metal by moving as a whole at least a part of the bottom section to which they are attached, respectively to a first position in which there is a continuous overflow on the first dam and no overflow on the second dam, and to a second position in which there is in addition an overflow on the second dam, the second position being below the first position, so as to allow cleaning differently of a front side liquid surface and a back side liquid surface, and wherein the snout comprises respective reservoirs configured to collect liquid flow passing over the first dam and the second dam, the respective reservoirs being attached on the front side and back side of the bottom section, the reservoirs being fluidly connected together, and having a common liquid surface level, except a difference due to loss of pressure caused by flowrate difference.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
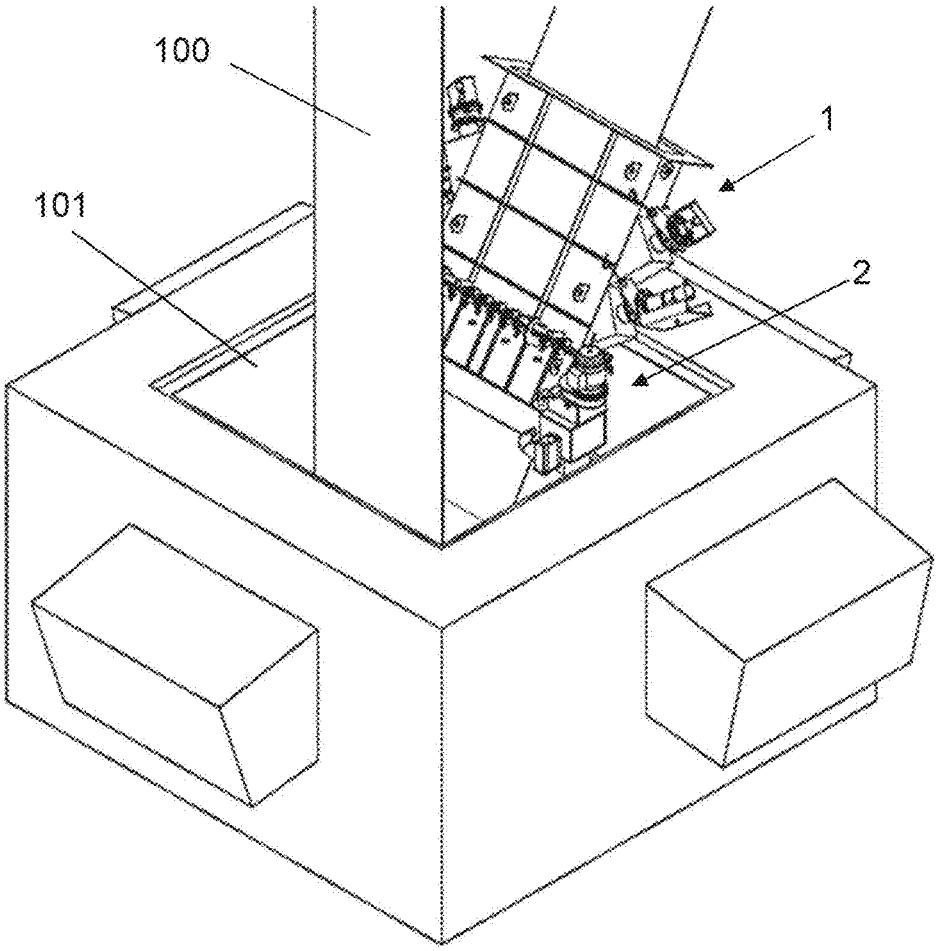
FIG. 1 represents a general perspective view of a hot-dip coating installation of a metal strip with molten metal, comprising an embodiment of a snout equipped with a cleaning device according to the present invention.

In an embodiment, the present invention provides a snout with cleaning device, intended to connect a liquid metal bath in a main pot to an annealing furnace in a continuous industrial installation for hot-dip coating a metal strip, said snout comprising a bottom section with a front side and a back side with respect to a strip in continuous movement entering into the bath in use, and comprising a cleaning device for differently cleaning the liquid metal surface located at said front side and said back side respectively, wherein the cleaning device comprises a first dam located on the front side of the strip and a second dam located on the back side of the strip, said first dam and second dam being attached to the bottom section of the snout, said first dam top and second dam top having respective positions which are fixed relative to each other, wherein a top of said second dam is located in use 5 to 50 mm above a top of said first dam, wherein mechanical means are provided to simultaneously adjust vertically said first dam top and said second dam top relative to the surface of the liquid metal by moving as a whole at least a part of the bottom section to which they are attached, respectively to a first position in which there is a continuous overflow on the first dam and no overflow on the second dam and to a second position, in which there is in addition an overflow on the second dam, said second position being below, and preferably at least 20 mm below, said first position thereby allowing to clean differently the front side liquid surface and the back side liquid surface, and wherein the snout comprises respective reservoirs for collecting the liquid flow passing over the first dam and the second dam, said respective reservoirs being attached on the front side and back side of the bottom section, said reservoirs being fluidly connected together by submerged pipes or similar devices and further having a common liquid surface level, except the difference due to pressure loss possibly existing because of flowrate difference.

According to preferred embodiments, the snout additionally comprises one of the following features or a suitable combination thereof:

- the mechanical means are able to maintain the bottom section at the second position during less than five minutes, and preferably less than one minute, so as to create a discontinuous or sporadic overflow over the second dam, with still a continuous overflow over the first dam with higher flowrate in comparison with the corresponding continuous overflow at said first position;
- the bottom section with its respective dams and reservoirs make a single component that is movable as a single piece in case of replacement or maintenance, using specific tools dedicated to that operation;
- the snout comprises at least a pipe with pump(s), or similar device(s), to return the flow filling said reservoirs to the main pot;
- the snout comprises a system of pumps located on the sides thereof to continuously or discontinuously empty the respective reservoirs;
- the snout comprises a measuring device such as a laser to continuously check the level of the liquid metal in the reservoirs and/or the level of the liquid metal in the main pot;
- the snout comprises a pipe and a separate box connected to each reservoir to obtain an external measurement of the liquid level in said reservoir;
- the top of one or both dams has a tapered edge, between 1 and 10 mm thick, said top being preferably coated or plate-covered with a nonstick compound such as ceramic, enamelled cast iron, carbon, oxidized or stainless steel, to minimize particle attachment;
- the reservoirs and piping have small holes at their lower part to allow full draining of the liquid when the device is removed form the liquid metal bath.

Another aspect of the present invention relates to a use of the snout with cleaning device as described above, wherein the flow over the first dam is adjusted by positioning of the bottom section relative to the liquid metal surface, either by increasing the level of the liquid metal in the main pot, by adding an ingot to the main pot, or by adjustment of the bottom section using said mechanical means and a displacement measuring device. Preferably, the mechanical means are screw jacks or similar devices.

Preferably, the flow over the second dam is obtained by moving downward the bottom section during less than one minute, so as to increase at the same time the flow over the first dam and further moving up the bottom section to come back to its initial position.

Still preferably, the pump rating is adjusted continuously to ensure that the common level in the reservoirs is lower than the level of liquid metal in the main pot.

Advantageously, the respective positions on the first dam and second dam inside the bottom section are copied on the outside of the system and/or on each external lateral face, thanks to position mark elements located at locations that cannot be damaged or hidden by liquid metal, dross or similar scraps, for allowing easy and accurate positioning of said dams horizontally.

In the above context, the inventors have observed that the need of cleaning the liquid surface is not the same for both sides. This is due to the geometric configuration of the pot equipment (see FIG. 1) and especially with the fact that the tunnel connecting the furnace and the pot, that must contain a non-oxidizing atmosphere for iron, has a defined angle. This angle is typically between 20° and 45° with reference to the vertical. This induces that the self cleaning of the surface due to the liquid entrained by the moving strip, due to viscosity and the flow induced by the sink roll as well, is different on both sides but also that the temperature map of the front and back side part of the snout shoe that is close to the wetting line is different. This is explained by the fact that the shape factor of the front side is higher and so the heat loss is increased compared to the back side that is facing the hot liquid metal.

Consequently the front side of the snout, that is also the side where the strip contacts the sink roll, requires more frequent cleaning than the back side. The design of the device according to the present invention is of the type with overflow both on the front side and on the back side of the strip. In particular, the chosen design will allow to clean both sides differently with preference and specific attention for the front side. Therefore, according to the invention, a dam will be installed on each side of the strip, a front dam and a back dam, but having different heights, so as to ensure a continuous flow over the front dam, while only an intermittent or sporadic flow can be obtained on the back dam, thanks to immersing during a limited time at least a part of the bottom section of the snout into the bath.

The system will work in standard conditions in a liquid level control mode in which continuous overflow is only performed on the front side of the strip. When it come to the cleaning mode, an overflow is performed on both sides of the strip.

This can be obtained according to the invention by moving the position of both dams as a whole relative to the liquid metal surface. This can be done in practice either by increasing the level of the liquid surface for example by adding a solid phase in the bath such as an ingot but it could also be done by submerging some part of the equipment that would be removed afterwards from the liquid and raised to come back to an initial level. Another convenient means to change the relative positions liquid surface/dam is to move down the full compartment with a mechanical device like screw jacks attached to the main part of the connecting tunnel.

It is clear that when there is a flow over the back dam, the flow over the front dam is significantly increased. The reservoirs made by both dams have to be connected by pipes as well as by an auxiliary reservoir that is used to accurately measure the liquid levels in the front and back reservoirs, said levels being identical by virtue of the principle of communicating vessels.

Also, in order to ensure appropriate overflow, the separation between both dams will be between 100 and 300 mm, and preferably between 100 and 150 mm. Furthermore the strip will be in an intermediate position between the dams but not specifically in the center. This position will be adjustable during production, thanks to tilting and immersion of the snout.

The adjustment of the overflow plates is a key towards efficiency of the process. The snout shall be equipped with a mechanism that allows to perform horizontal levelling of the dam top. This is a key towards success in order to have the same overflow all along the dam. Two indicators of parallelism are advantageously deported on the face of the snout to allow online measurement (with a theodolite) and adjustment. In order to facilitate the adjustments, the snout will be also advantageously provided with an external camera providing images of the surface of the liquid in the snout and the overflow of liquid.

Figure 5:
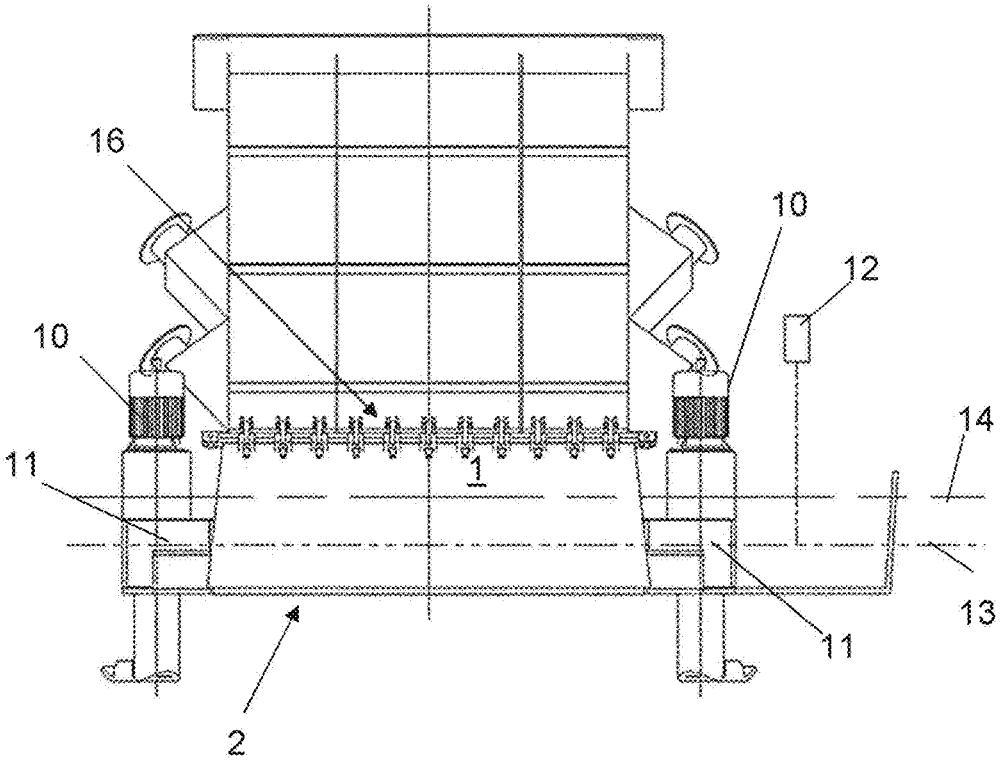
FIG. 5 represents a front elevation view of the snout equipped with a cleaning device according to the present invention.
Figure 4:
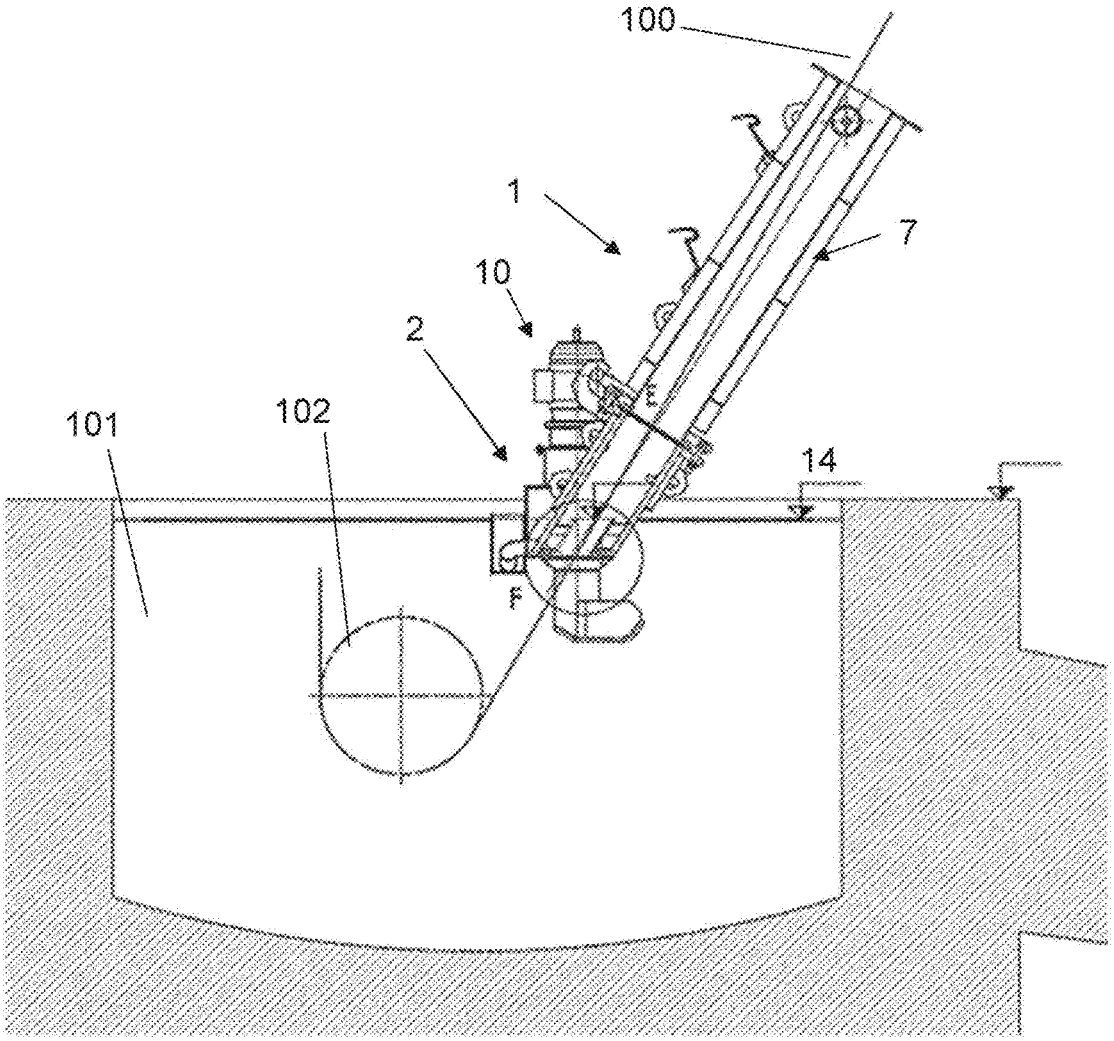
FIG. 4 represents a general cross-sectional view of the hot-dip coating installation in operation, in which the snout equipped with a cleaning device is submerged in a position corresponding to the level control mode with continuous overflow performed only on the front side of the strip.

In order to master the overflow over the respective dams, pumps or impellers are installed for draining the reservoirs, and rejecting the pumped liquid in the main bath (FIG. 4). The pumping system is preferably using two units, one on each side of the device but only one of them may be used with reference to the amount of liquid to return to the main pot (FIG. 5).

The reference pumps have a flow control in such a way that their flow is adjusted with the total flow passing the dams. Therefore the reference pumps shall be driven by a controllable device that is preferably an electrical motor with variable speed. A closed loop is advantageously done with the immersion of an ingot on that purpose or alternately a change of the immersion of the complete device.

The inventors have also observed that the rotation of the shaft of a pump at the wetting line may generate more or less of a solid compound make of metal oxide and pure metal. This is explained by the turbulence in the liquid metal around the shaft that promotes the oxidation of the liquid metal that in turn induces a type of metal foam. It has then been observed that the amount of that type of foam significantly increases with the rotation speed of the pump. Therefore, the use of more than two pumps will be preferred, in continuous rotation but at reduced speed.

Finally, the inventors have observed that, in order to optimize the efficiency of the system, the top part of the dams must have very specific characteristics summarized below:

- in order to ease the flow of liquid over it and prevent accumulation on the plate, the top part of the dam must have a sharp edge, preferably between 1 and 10 mm thick and more preferably between 2 and 5 mm thick. Such a design permits to avoid adhesion of dross or solid particles like those that are intended to be removed from the surface of the liquid. The top of the blade may also be advantageously coated with a non-stick compound to further minimize particle attachment that may disturb the uniformity of the flow;
- the top of the dam must be as parallel as possible to the liquid surface. A typical difference between 0 and 4 mm and preferably less than 2 mm must be obtained in operation between the left and right part of the dam. Therefore, the supporting mechanical device allows to correct the transversal tilting of the blade by moving the whole device. Because the visibility inside the device is reduced, which means that the top of the blade may not be seen on its total length, two reference points should be added on the tunnel on which the dams are fixed, in a position such that they are clearly visible and outside of any possible damage by the liquid zinc and/or environment.

DESCRIPTION OF A PREFERRED EMBODIMENT OF THE INVENTION

FIG. 1 describes the pot area in a hot-dip galvanization installation with a snout with a cleaning device according to the invention. The modified snout is assembled either by bolts or by welds on the tunnel that is connected to the main part of the annealing furnace.

FIG. 2 is a lateral cross-sectional view of the bottom of the modified snout 1 where the front dam 4 and the back dam 5 are represented. In a first operational mode (level control mode), only a single flow is continuously present, the latter over the front dam 4. The liquid seal level 61 is between 5 and 20 mm, and preferably between 5 to 10 mm over the top of the front dam 4, but said liquid seal level 6 is below the top of the back dam 5. The back dam 5 is 5 to 50 mm higher than the front dam, and preferably 20 to 30 mm higher than the front dam 4. In a second operational mode (cleaning mode), which is discontinuous, the whole snout is dipped, for example by 20 mm, in a short time which create a continuous overflow over the front dam 4 (which is more important than the corresponding overflow in the first mode) and a short time sporadic overflow on the back dam 5, which allows to clean the back side of the strip. Finally a mixed mode is also possible combining the level control mode and the cleaning mode.

Figure 2A:
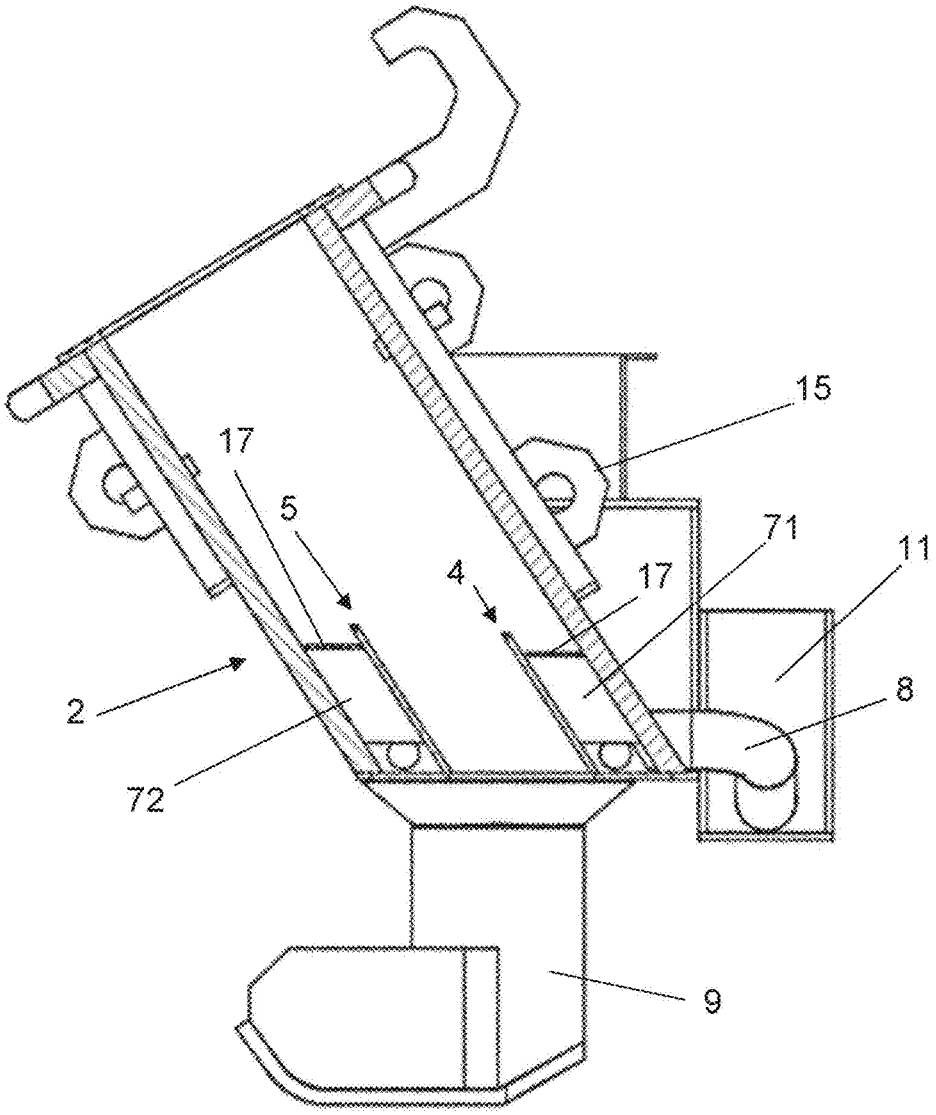
FIG. 2A represents a lateral cross-sectional view of the snout equipped with a cleaning device according to the present invention.
Figure 2B:
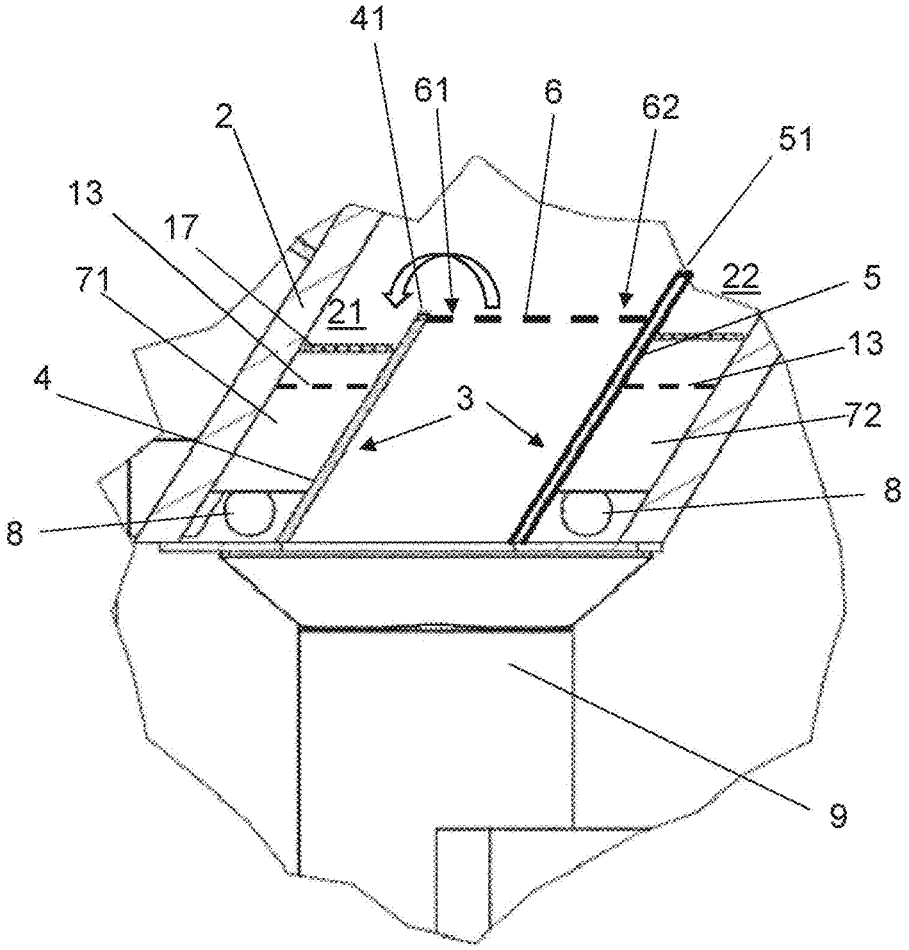
FIG. 2B represents a detail view of the bottom section of the snout equipped with a cleaning device according to FIG. 2A.

Reservoirs 71, 72 collecting the overflows are connected by at least a pipe 8 (FIGS. 2A and 2B). This implies that the liquid levels in the two reservoirs are identical. The depth of each reservoir is between 100 and 400 mm, and preferably between 200 to 300 mm. The overflows, collected in the reservoirs 71, 72, are returned to the main pot through a return pipe 9. Various pumps 10 (FIGS. 4 and 5) may be installed and working in parallel mode. The preference is to use two pumps 10 which is a good compromise for industrial operation, considering the constraints around the pot area.

Additional reservoirs 11 are connected to the main ones to "copy" the liquid level position in the main reservoir(s). A measuring unit 12 drives the pump flow to ensure that the level 13 in the reservoirs is below the liquid level 14 in the main pot (FIG. 5).

The pumps or impellers are rotated preferentially by an electrical variable motor but other devices like an air motor may be used alternately.

The snout device is assembled to the main furnace tunnel 7 by a series of bolts or jacks 16, as well as the required devices to ensure a perfect tightness and avoid air entry inside the tunnel 7.

Figure 3:
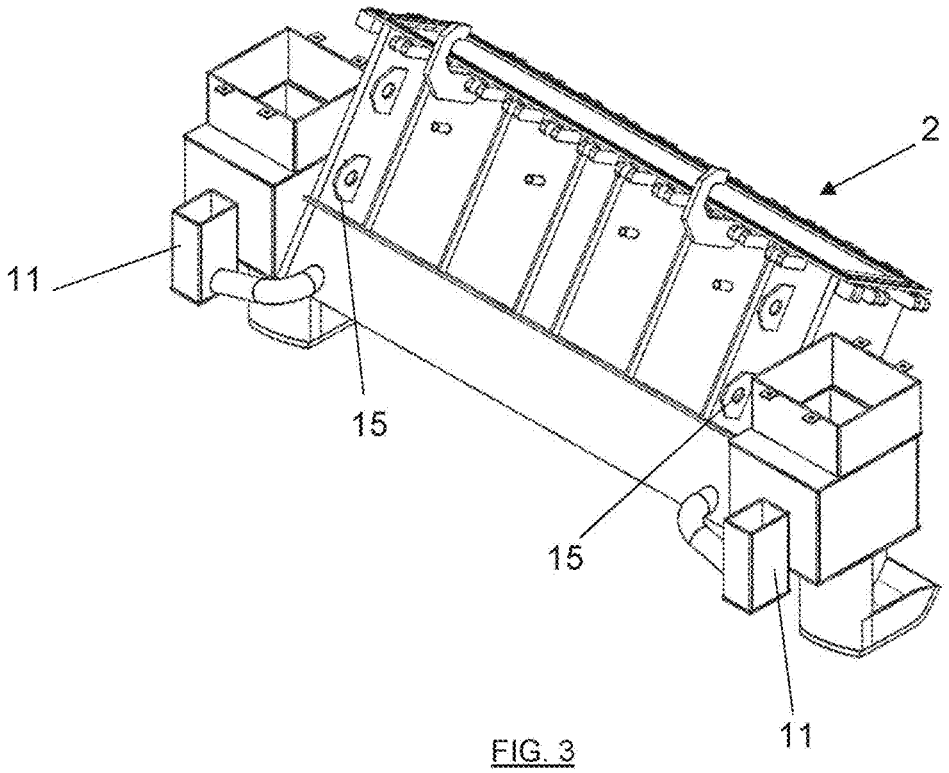
FIG. 3 represents a perspective view of the snout equipped with a cleaning device according to the present invention.

The dams 4, 5 that are welded to the casing 2 are adjusted in horizontal position thanks a mechanical device 15 such as hooks (FIG. 3) that allow to adjust horizontality of the dams by tilting. The specific reference points are located in front areas where they are easily visible but without any risk to be "damaged" by the industrial operation causing liquid splash, corrosion or similar. Besides hooks, other possibilities exist under the scope of the present invention.

In order to stabilize the strip and to position the strip in the snout, a roll may be placed advantageously in the snout. The roll will induce a deflection of the strip preferably between 0 and 100 mm. The roll will preferentially be motor-driven to avoid scratches.

Molten metal evaporates in the snout, which is detrimental to the equipment. To limit evaporation, wet gas will be advantageously injected in the snout end. The wet gas creates an oxide layer at the surface of the molten metal which is protecting from evaporation. When liquid is overflowing, this layer is continuously broken, and evaporation cannot be prevented. The level control mode with continuous cleaning only on one side allows to limit zinc evaporation from the surface of the bath on one side of the strip.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCES

1 snout
2 lower part or shoe of the snout
3 cleaning device
4 first (front) dam
5 second (back) dam
6 liquid metal seal (surface)
7 tunnel of annealing furnace
8 submerged pipe (connecting reservoirs)
9 return pipe to main pot
10 pump
11 level measurement reservoir
12 measurement laser
13 liquid level in the reservoirs
14 liquid level in the main pot
15 dam position mark
16 screw jack
17 grid/filter
21 front side of snout bottom section
22 back side of snout bottom section
41 top of first dam
51 top of second dam
61 front side liquid surface
62 back side liquid surface
71 front side reservoir
72 back side reservoir
100 metal strip
101 main molten metal pot
102 bottom roll

The invention claimed is:

1. A snout with cleaning device for connecting a liquid metal bath in a main pot to an annealing furnace in a continuous industrial installation for hot-dip coating a metal strip, the snout comprising:

a bottom section with a front side and a back side with respect to the metal strip in continuous movement entering into the liquid metal bath in use; and a cleaning device configured to differently clean a liquid metal surface located at the front side and the back side respectively, the cleaning device comprising a first dam located on the front side of the metal strip and a second dam located on the back side of the metal strip, the first dam and second dam being attached to the bottom section of the snout, a first dam top and a second dam top having respective positions which are fixed relative to each other, wherein the second dam top is located 5 to 50 mm above the first dam top, wherein mechanical means are provided to simultaneously adjust vertically the first dam top and the second dam top relative to a surface of the liquid metal by moving as a whole at least a part of the bottom section to which they are attached, respectively to a first position in which there is a continuous overflow on the first dam and no overflow on the second dam, and to a second position in which there is in addition an overflow on the second dam, the second position being below the first position, so as to allow cleaning differently of a front side liquid surface and a back side liquid surface, and wherein the snout comprises respective reservoirs configured to collect liquid flow passing over the first dam and the second dam, the respective reservoirs being attached on the front side and back side of the bottom section, the reservoirs being fluidly connected together, and having a common liquid surface level, except a difference due to loss of pressure caused by flowrate difference.

2. The snout of claim 1, wherein the mechanical means are configured to maintain the bottom section at the second position for less than five minutes so as to create a discontinuous or sporadic overflow over the second dam, with still a continuous overflow over the first dam with higher flowrate in comparison with a corresponding continuous overflow at the first position.

3. The snout of claim 1, wherein the bottom section with its respective dams and reservoirs comprise a single component that is movable as a single piece in case of replacement or maintenance, using specific tools.

4. The snout of claim 1, further comprising:

at least a pipe with pump(s) configured to return a flow filling the reservoirs to the main pot.

5. The snout of claim 1, further comprising:

a system of pumps located on sides of the snout, the system of pumps being configured to continuously or discontinuously empty the respective reservoirs.

6. The snout of claim 1, further comprising:

a measuring device configured to continuously check a level of the liquid metal in the reservoirs and/or a level of the liquid metal in the main pot.

7. The snout of claim 1, further comprising:

a pipe and a separate box connected to each reservoir to obtain an external measurement of a liquid level in the reservoir.

8. The snout of claim 1, wherein a top of one or both dams has a tapered edge, between 1 and 10 mm thick.

9. The snout of claim 1, wherein the reservoirs and piping have small holes at lower parts thereof to allow full draining of the liquid when the cleaning device is removed from the liquid metal bath.

10. A method for hot-dip coating a metal strip-using the snout of claim 1, the method comprising:

adjusting a flow over the first dam by positioning the bottom section relative to the liquid metal surface, either by increasing a level of the liquid metal in the main pot, adding an ingot to the main pot, or adjustment of the bottom section using the mechanical means and a displacement measuring device.

11. The method of claim 10, wherein the mechanical means comprise screw jacks.

12. The method of claim 10, wherein a flow over the second dam is obtained by moving downward the bottom section for less than one minute, so as to increase at a same time a flow over the first dam and further moving up the bottom section to come back to an initial position thereof.

13. The method of claim 10, wherein the pump rating is adjusted continuously to ensure that a common level in the reservoirs is lower than a level of liquid metal in the main pot.

14. The method of claim 10, wherein respective positions on the first dam and second dam inside the bottom section are copied on an outside of the system and/or on each external lateral face by position mark elements located at locations that cannot be damaged or hidden by liquid metal, dross, or similar scraps, so as to allow easy and accurate positioning of the dams horizontally.

15. The snout of claim 1, wherein the reservoirs are fluidly connected together by submerged pipes.

16. The snout of claim 2, wherein the mechanical means are configured to maintain the bottom section at the second position for less than one minute.

17. The snout of claim 6, wherein the measuring device comprises a laser.

18. The snout of claim 8, wherein the top of one or both dams is coated or plate-covered with a nonstick compound.

19. The snout of claim 18, wherein the nonstick compound comprises ceramic, enameled cast iron, carbon, oxidized steel, or stainless steel.

* * * * *